United States Patent [19]

Rauchfuss

[11] 4,069,283

[45] Jan. 17, 1978

[54] METHOD OF CURING AND PROTECTING A CONCRETE COLUMN

[76] Inventor: Arthur A. Rauchfuss, P. O. Box 25, Patterson, N.C. 28661

[21] Appl. No.: 673,685

[22] Filed: Apr. 5, 1976

[51] Int. Cl.[2] ..... E04B 1/16

[52] U.S. Cl. ..... 264/32; 52/173 R; 264/79; 264/DIG. 43

[58] Field of Search ..... 264/32, 79, 333, DIG. 43 A, 264/DIG. 43 C; 52/173

[56] References Cited

U.S. PATENT DOCUMENTS

| | | | |
|---|---|---|---|
| 2,677,165 | 5/1954 | Copenhauer | 264/338 X |
| 3,427,374 | 2/1969 | Jackson | 264/79 |
| 3,644,611 | 2/1972 | Wiles | 264/334 |
| 3,904,723 | 9/1975 | Prince | 264/79 X |

FOREIGN PATENT DOCUMENTS

| | | | |
|---|---|---|---|
| 809,082 | 2/1959 | United Kingdom | 264/79 |

*Primary Examiner*—Thomas P. Pavelko
*Attorney, Agent, or Firm*—Bell, Seltzer, Park & Gibson

[57] ABSTRACT

A method of efficiently curing and protecting a structural concrete column, beam or the like and which includes the steps of filling the form with concrete, removing the form upon the concrete becoming sufficiently rigid to be self-supporting but prior to the full curing thereof, and then disposing a tubular length of polymeric sheet material coaxially about the column and maintaining the same thereabout until the concrete is fully cured.

5 Claims, 2 Drawing Figures

METHOD OF CURING AND PROTECTING A CONCRETE COLUMN

Figure 1:
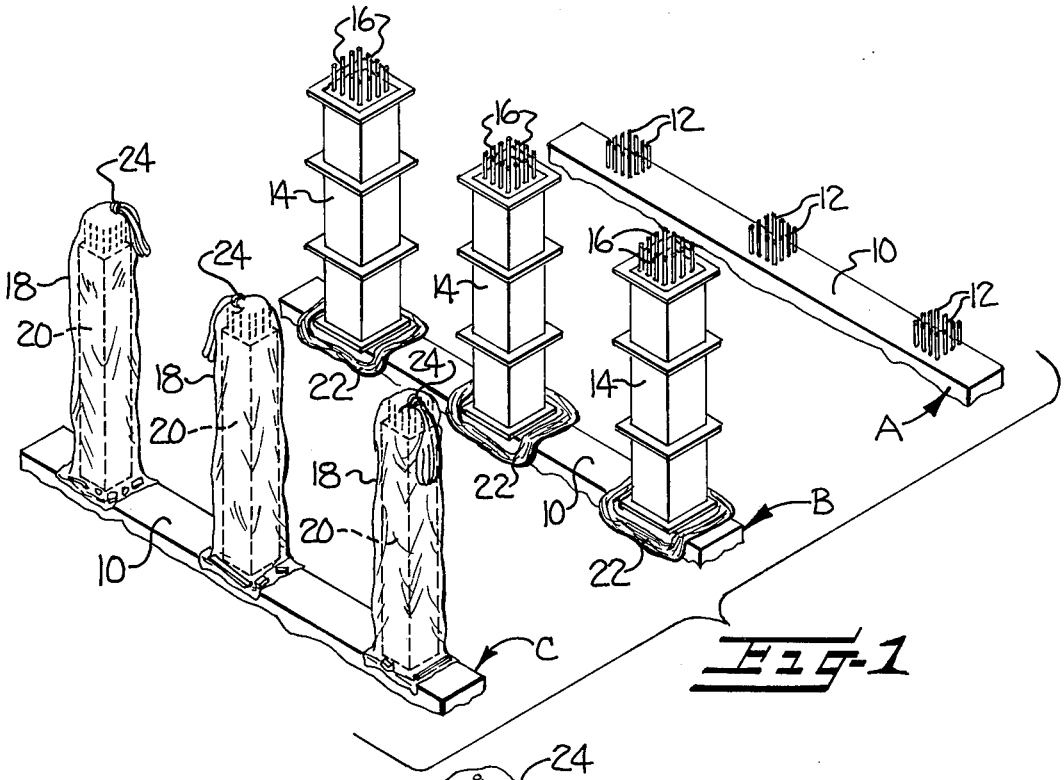

The present invention relates to a method for efficiently curing and protecting a structural concrete column, beam or the like and which is characterized by the short duration use of the conventional form, to thereby permit an overall reduction in the number of forms required at a particular construction site.

In the concrete construction industry, it is recognized that adequate curing is essential to bring the concrete to its required strength and quality. Since curing involves the hydration of the cementing material, an adequate supply of moisture within the concrete is necessary for proper curing, and for this reason, it is conventional to employ various means for minimizing moisture loss during the curing process. Thus in the case of flat nonformed surfaces, such as a roadway, the surfaces are commonly covered with wet straw, plastic sheets, liquid membrane or the like immediately after final finishing to prevent undue loss of moisture. In the case of formed concrete columnar structures, such as vertical columns or horizontal beams, it is conventional to maintain the forms on the concrete for the full period of the curing process, which typically involves from three to seven days, for this purpose. Such forms are typically fabricated from wood, steel, or fiberglass.

Leaving the forms on the concrete columnar structure for a number of days results in a relatively large number of forms being required at each particular job site. In addition, since the forms are relatively expensive, it will be appreciated that the required number of forms involves a large monetary investment. To alleviate this problem, it has been proposed that burlap or plastic sheets be helically disposed about the structural member after the concrete has partially cured and the forms have been removed. However, this latter procedure is also unsatisfactory since helically wrapping the sheet material about the structural member is a laborious and time-consuming process, and in addition, the transverse seams between the helical windings often separate from the wind or other external forces to thereby destroy the effectiveness of the sheet material in preventing moisture loss.

It has also been proposed to coat concrete with a liquid membrane curing compound, which is sprayed onto the concrete to form a thin resinous film on the surface thereof. This procedure is not totally satisfactory however, since the resinous film prevents the bonding of paint or other subsequently applied coating. Also, the film is not a totally effective moisture barrier.

It is accordingly an object of the present invention to provide a method of efficiently curing and protecting a structural concrete column, beam or the like and wherein the form is employed for only a portion of the time required to fully cure the concrete to thereby permit an overall reduction in the number of forms required at a particular construction site.

It is another object of the present invention to provide a method of efficiently covering a partially cured concrete column, beam or the like with a moisture impermeable barrier to thereby preclude moisture loss from the concrete during the curing process. Further, the barrier serves to retain the heat derived from the radiant energy of the sun which also facilitates the curing process, and the barrier protects the surface of the concrete from being stained by external substances.

It is still another object of the present invention to provide a concrete columnar structure adapted to form a column or beam in a building, roadway bridge or the like and which includes a tubular length of moisture impermeable sheet material disposed loosely and coaxially about the entire length of the concrete structural member, the sheet material being continuous throughout its length and free of transverse seams.

These and other objects and advantages are achieved in the present invention by the provision of a method which includes the steps of assembling the form to define the desired configuration of a columnar structural member, and filling the form with plastic concrete. Upon the concrete becoming sufficiently rigid to be self-supporting, the form is removed to thereby permit its immediate re-use, and a tubular length of moisture impermeable sheet material is coaxially disposed about the partially cured concrete and is maintained thereabout until the concrete has substantially fully cured. In a preferred embodiment, a gathered length of the tubular sheet material is disposed about the form so as to encircle one end thereof, and after the removal of the form, one end of the sheet material is translated coaxially along the concrete structural member to result in the sheet material being coaxially disposed thereabout.

Figure 2:
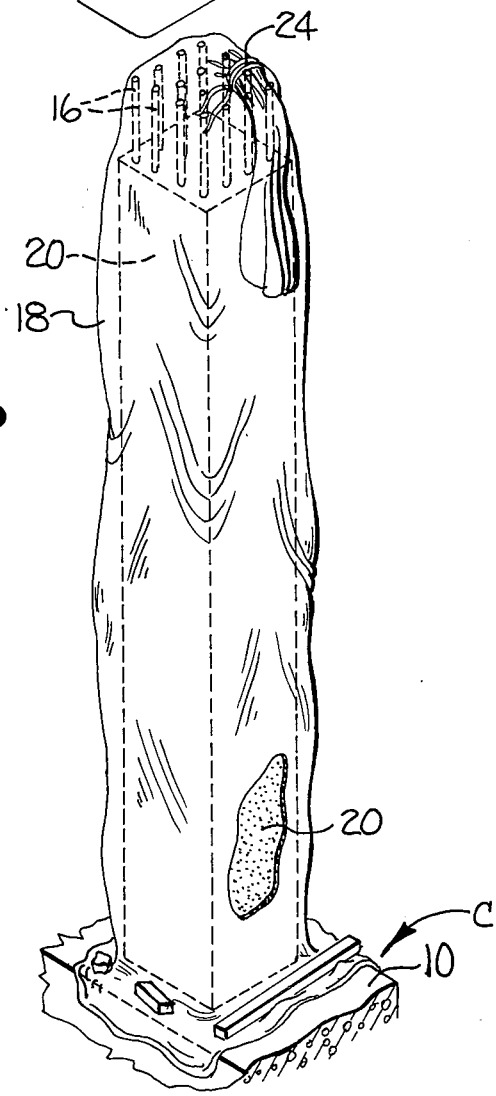

FIG. 1 is a fragmentary perspective view illustrating the steps involved in forming a plurality of concrete columns in accordance with the present invention; and FIG. 2 is an enlarged perspective view of one of the columns shown in FIG. 1.

Referring more specifically to the drawings, FIG. 1 illustrates the steps involved in forming a plurality of concrete structural columns to be employed, for example, as the supporting foundation for an elevated roadway or bridge. In particular, a concrete footing 10 is initially formed as shown at A in FIG. 1, the footing 10 including conventional upright steel reinforcing rods 12 positioned at the intended location of each of the columns. Next, a hollow form 14 for each of the columns is assemblied upon the footing 10 as shown at B. Typically, each form A is composed of relatively heavy plywood segments which are bolted together to define the desired columnar structure. Also, additional steel reinforcing rods 16 are disposed within each of the forms 14, the rods 16 extending beyond the upper ends of the forms for interconnection with a subsequently formed horizontal beam or the like.

The assemblied forms 14 are then filled with plastic concrete, and the forms are maintained in this position until the concrete has become sufficiently set to be self-supporting, which normally occurs after about one day. The forms are then removed to permit their immediate re-use at another location at the construction site.

Upon the removal of the forms 14, a length of moisture impermeable tubular sheet material 18 is disposed coaxially about the resulting concrete column 20 as seen at C in FIG. 1 and in FIG. 2, and the sheet material 18 is maintained in this position until the concrete is substantially fully cured. As noted above, full curing typically requires up to about 7 days after the concrete is initially poured into the form.

In a preferred embodiment, the tubular sheet material 18 is initially gathered into an open, circular ring 22, and the ring is positioned coaxially over the top of the form and lowered downwardly so that it rests at the lower end of the form. This may be accomplished either before or after the form is filled with the concrete. Thus upon removal of the form, the sheet material 18 is in a position where it may be quickly and easily drawn upwardly over the length of the column 20 by translating one end upwardly along the column while maintaining the other end at the bottom thereof. The prior positioning of a ring 22 about the form and column in this manner has the advantage of permitting the further assembly of a cooperating concrete beam or the like at the upper end of the column prior to the removal of the form. In other words, the further construction may close or block the upper end of the column, which would then preclude the positioning of the tubular member about the column.

In the illustrated embodiment, the upper end of the tubular material 18 is gathered and closed over the upper end of the column 20 by means of a hand tied cord 24 or the like. Where the upper end of the column 20 is blocked by a horizontal beam or the like, the tubular material may be secured in its raised position by other suitable means, such as a circumferential binding (not shown) positioned about the upper end of the column and tubular material. In either event, the concrete column 20 has a tubular length of moisture impermeable sheet material 18 disposed loosely and coaxially about the entire length of the column, the sheet material being continuous throughout its length and free of transverse seams.

The tubular sheet material 18 preferably has a diameter substantially greater than that of the column 20 and form 14, to permit the tubular material to be readily positioned thereabout. Also, the tubular material is preferably fabricated from a moisture impermeable polymeric material, such as polyethylene sheet material, and has a thickness of between about four to ten mils. Thus the sheet material serves to preclude moisture loss from the concrete to facilitate its proper curing, and it also acts to retain heat from the sun's radiant energy to further facilitate curing. The sheet material also serves to protect the surface of the concrete column from being stained by external substances, such as mud, paint, or concrete being poured at an overhead or adjacent location.

Upon the concrete in the column 20 becoming fully cured, the tubular sheet material 18 may be removed by simply cutting it along its length and pulling it from the column. Alternatively, the material 18 may be withdrawn over the upper end of the column where the same is not blocked, to thereby permit the material to be re-used.

In the drawings and specification, there has been set forth a preferred embodiment of the invention, and although specific terms are employed, they are used in a generic and descriptive sense and not for purposes of limitation.

That which is claimed is:

1. A method of efficiently curing and protecting a structural concrete column, beam, or the like and characterized by the short duration use of the form to thereby permit an overall reduction in the number of forms required at a particular construction site, and comprising the steps of assembling a form to define the desired configuration of a columnar structural member at the intended permanent location of the structural member, filling the assembled form with plastic concrete, removing the form from the concrete upon the same becoming sufficiently rigid to be self-supporting but prior to the full curing thereof, and then translating a continuous tubular length of sheet material coaxially along the self-supporting concrete so as to be disposed about the entire length thereof and maintaining the same in such position until the concrete is substantially fully cured, the sheet material thereby serving to substantially preclude moisture loss from the concrete while protecting the same from being stained by external substances.

2. The method as defined in claim 1 wherein the step of disposing the sheet material about the concrete includes securing the sheet material in its position about the concrete to preclude the inadvertent removal of the sheet material therefrom.

3. The method as defined in claim 2 comprising the further subsequent step of removing the sheet material from the concrete after the same has become fully cured.

4. The method as defined in claim 3 wherein the sheet material comprises a moisture impermeable polymeric material.

5. A method of efficiently curing and protecting a structural concrete column, beam, or the like and characterized by the short duration use of the form to thereby permit an overall reduction in the number of forms required at a particular construction site, and comprising the steps of assembling a form to define the desired configuration of a columnar structural member at the intended permanent location of the structural member, filling the assembled form with a plastic concrete, disposing a gathered continuous tubular length of moisture impermeable sheet material about the form so as to encircle one end thereof, the sheet material having a length at least as great as the length of the columnar structural member, removing the form from the concrete upon the same becoming sufficiently rigid to be self-supporting but prior to the full curing thereof, and then translating one end of the sheet material coaxially along the concrete to result in the sheet material being coaxially disposed about the entire length of the concrete, and maintaining the sheet material in such position until the concrete is substantially fully cured.

* * * * *